United States Patent [19]

Castonguay et al.

[11] 4,079,214

[45] Mar. 14, 1978

[54] DEFEATABLE ACCESS DOOR INTERLOCK FOR CIRCUIT BREAKER ENCLOSURE

[75] Inventors: Roger N. Castonguay, Terryville; Charles L. Jencks, Avon, both of Conn.

[73] Assignee: General Electric Company, New York, N.Y.

[21] Appl. No.: 750,668

[22] Filed: Dec. 15, 1976

[51] Int. Cl.[2] ..... H01H 9/20; H01H 33/46

[52] U.S. Cl. ..... 200/50 A; 200/42 A

[58] Field of Search ..... 200/50 A, 42 R, 42 T; 361/343, 344

[56] References Cited

U.S. PATENT DOCUMENTS

| | | | |
|---|---|---|---|
| 2,917,593 | 12/1959 | Groves | 200/50 A |
| 3,511,447 | 5/1970 | Eikermann | 200/50 A |
| 3,978,304 | 8/1976 | Salvati | 200/50 A |
| 4,000,478 | 12/1976 | Jencks | 200/50 A |

*Primary Examiner*—Robert K. Schaefer
*Assistant Examiner*—William L. Feeney
*Attorney, Agent, or Firm*—Robert A. Cahill; Walter C. Bernkopf; Frank L. Neuhauser

[57] ABSTRACT

A door interlock includes first and second, normally intercoupled plates mounted to a circuit breaker for sliding movement between respective first and second positions. The first plate includes an aperture through which a circuit breaker trip pushbutton normally extends, thereby sustaining the plates in their first positions where the second plate serves as a catch for the door of the breaker enclosure. Upon depression of the trip pushbutton, the breaker is tripped and the plates may be conjunctively slid to their second positions where the first plate sustains the depressed condition of the pushbutton to ensure that the breaker is open, while the second plate clears the enclosure door such that it can be opened. If desired, the intercoupling between the plates may be defeated, such that the second plate can be slid to its second position independently of the first plate, and the door may be opened while the circuit breaker is closed. The first plate can also be padlocked in a third position where it is effective to sustain depression of the trip pushbutton and inhibit opening of the enclosure door.

16 Claims, 7 Drawing Figures

DEFEATABLE ACCESS DOOR INTERLOCK FOR CIRCUIT BREAKER ENCLOSURE

BACKGROUND OF THE INVENTION

Electrical switchboards and other forms of circuit breaker enclosures are typically constructed with cubical or enclosure access doors having openings through which the circuit breaker operating handles extend for convenient manual operation by operating personnel without the necessity of opening the access doors. As a safety precaution for operating personnel, it is common practice to equip each switchboard cubical or circuit breaker enclosure with an interlock which functions to prevent or at least discourage opening of the access door unless and until the circuit breaker therein is open, i.e., OFF.

There are occasions however when it would be most advantageous, if not an absolute necessity, from the standpoint of avoiding disruption of electrical service, for maintenance personnel to gain access to the enclosure without first having to open the circuit breaker. As a consequence, these door interlocks must somehow be defeatable. One way of accomplishing this would be to install the interlock in a manner such that it can be completely removed. This is not a particularly attractive recourse in view of the time and effort required of authorized maintenance personnel. Moreover, defeating the door interlock by its complete removal would be a readily apparent recourse to unauthorized personnel bent on access to the enclosure, and thus any facility in doing so would detract from the intended purpose of discouraging unauthorized access while the circuit breaker is closed. Thus, for the interlock to be effective for its intended purpose, defeatablility should be unobvious to uninformed personnel, regardless of whether it is convenient or not.

It is accordingly an object of the present invention to provide a door interlock for effectively discouraging access to an electrical enclosure while the circuit breaker therein is closed, and yet is readily defeatable by informed, authorized personnel.

A further object of the present invention is to provide a door interlock of the above character which is equipped with unobtrusive interlock defeating provision.

Yet another object of the present invention is to provide an interlock of the above character having provisions for simultaneously padlocking the circuit breaker in its open condition and the enclosure door in its closed position.

An additional object is to provide a door interlock of the above character which is simple in construction, economical to manufacture, reliable in service, convenient to operate by operating personnel in its undefeated condition and readily defeatable by informed maintenance personnel.

Other objects of the invention will in part be obvious and in part appear hereinafter.

In accordance with the present invention, there is provided an interlock for controlling the opening of an access door to an electrical enclosure in accordance with the condition of a circuit breaker situated therein. The interlock includes first and second members commonly mounted to the circuit breaker for movements between respective first and second positions. The first member carries control means disposed in operative relation with a circuit breaker pushbutton which is manipulated from an elevated condition to a depressed condition to convert the breaker from its ON to its OFF condition. Moreover, this pushbutton, while in its depressed condition, inhibits conversion of the breaker from its OFF to its ON condition.

More specifically, the first member control means is arranged to abut the pushbutton in its elevated positions to preclude movement of the first member from its first to its second position. Further, with the pushbutton in its depressed condition, the control means clears the pushbutton to permit movement of the first member from its first position to its second position, and, with the first member at second position, the control means engages the pushbutton to sustain its depressed condition. The second member carries catch means which is disposed, with the second member in its first position, to interfere with the opening of the access door and is disposed, with the second member in its second position, to clear the access door so as to permit opening same.

Coupling means are provided to normally intercouple the first and second members for conjunctive movement between their respective first and second positions. Consequently, the access door cannot be opened until the circuit breaker pushbutton is depressed to open the circuit breaker and, at the same time, permit conjunctive movement of the members from their first positions to their second positions. To accommodate those situations when it is desirable to gain access to the enclosure without having to open the circuit breaker, the coupling means is uniquely designed to be readily, but unobtrusively defeatable by informed personnel so as to decouple the first and second members. With the interlock defeated, the second member may be moved to its second position independently of the first member and thus without having to first depress the pushbutton to open the circuit breaker in order to open the access door.

The interlock of the present invention is further equipped to accommodate padlocking of the circuit breaker in its open condition and the access door in its closed condition. To this end, at least the first member is mounted for movement in a first direction from its first position to its second position and in an opposite direction from its first position to a third position. The control means precludes movement of the first member from its position to its second position until the pushbutton is depressed, and, while in this third position, the control means engages the pushbutton to sustain its depressed condition. Moreover, the first member, in its third position, serves as a catch to preclude opening of the access door. The first member is equipped with provision to accept the hasp of a padlock so as to effectively lock the first member thereat.

The invention accordingly comprises the features of construction, combination of elements, and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which.

Corresponding reference numerals refer to like parts throughout the several views of the drawings.

DETAILED DESCRIPTION

Figure 1:
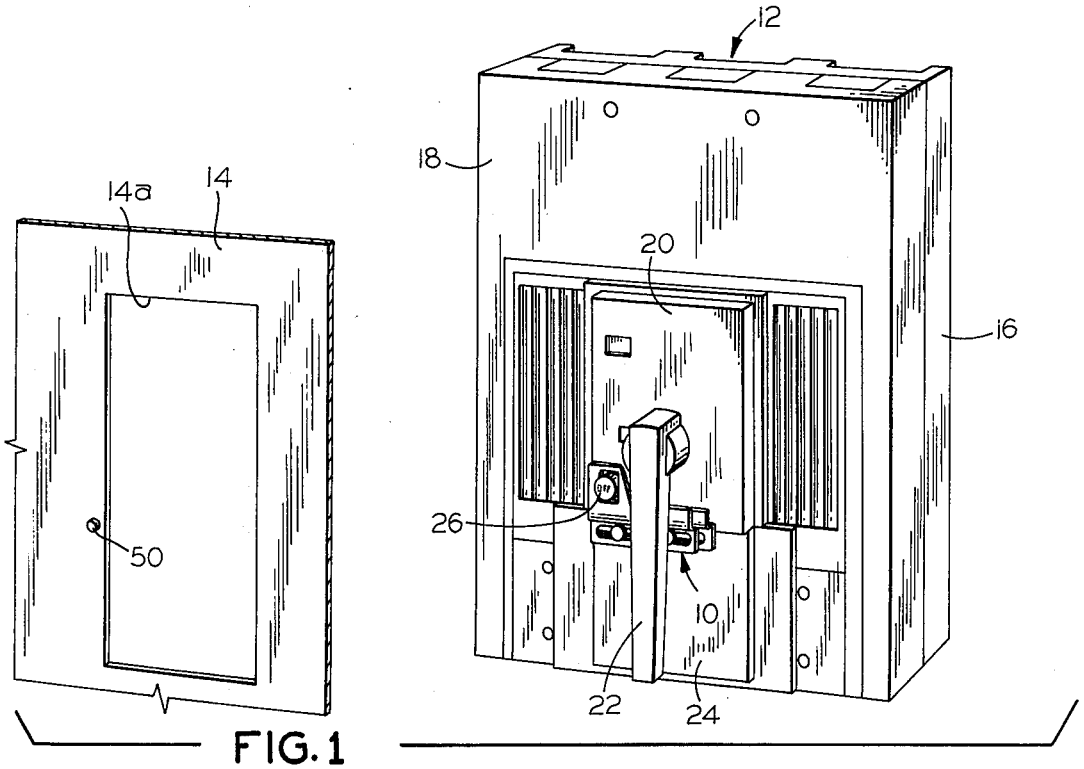
FIG. 1 is an exploded perspective view, partially broken away, of an industrial circuit breaker equipped with an enclosure access door interlock constructed in accordance with the present invention.

The door interlock of the present invention, generally indicated at 10 in FIG. 1, is shown adapted to an industrial, molded case circuit breaker, generally indicated at 12, which is installed in an electrical enclosure, such as a switchboard cubical (not shown), to which access is gained via a side hinged, frontal door 14. The circuit breaker, which may be of known construction such as currently being manufactured by the General Electric Company under the trademark POWER BREAK, includes a molded case consisting of a base 16 and a cover 18. The front surface of the case cover is provided with a raised, fixed escutcheon plate 20 to which a rotary operating handle 22 is mounted. Below the fixed escutcheon plate is a raised, removable escutcheon plate 24 affording access to the breaker trip mechanism for convenient trip setting adjustment. Protruding through the fixed escutcheon plate is a pushbutton 26 which, upon depression, trips the breaker operating mechanism, converting the breaker from its closed or ON condition to its open or OFF condition. As long as the pushbutton 22 is held depressed, the breaker latch is defeated and reclosure of the breaker via cranking of rotary handle 22 is precluded. The utilization of a pushbutton as a circuit breaker trip and reclosure prevention expedient is known, as illustrated in U.S. Pat. No. 3,343,109.

As seen in FIG. 1, the access door 14 is provided with a central, rectangular opening **14*a* through which the fixed and removable escutcheon plates protrude when the door is in its closed position. It is seen that opening 14*a* also serves to avoid interference with the rotary handle 22 as the door 14** is swung open to gain access to the interior of the electrical enclosure in which the circuit breaker is accommodated.

Figure 2:
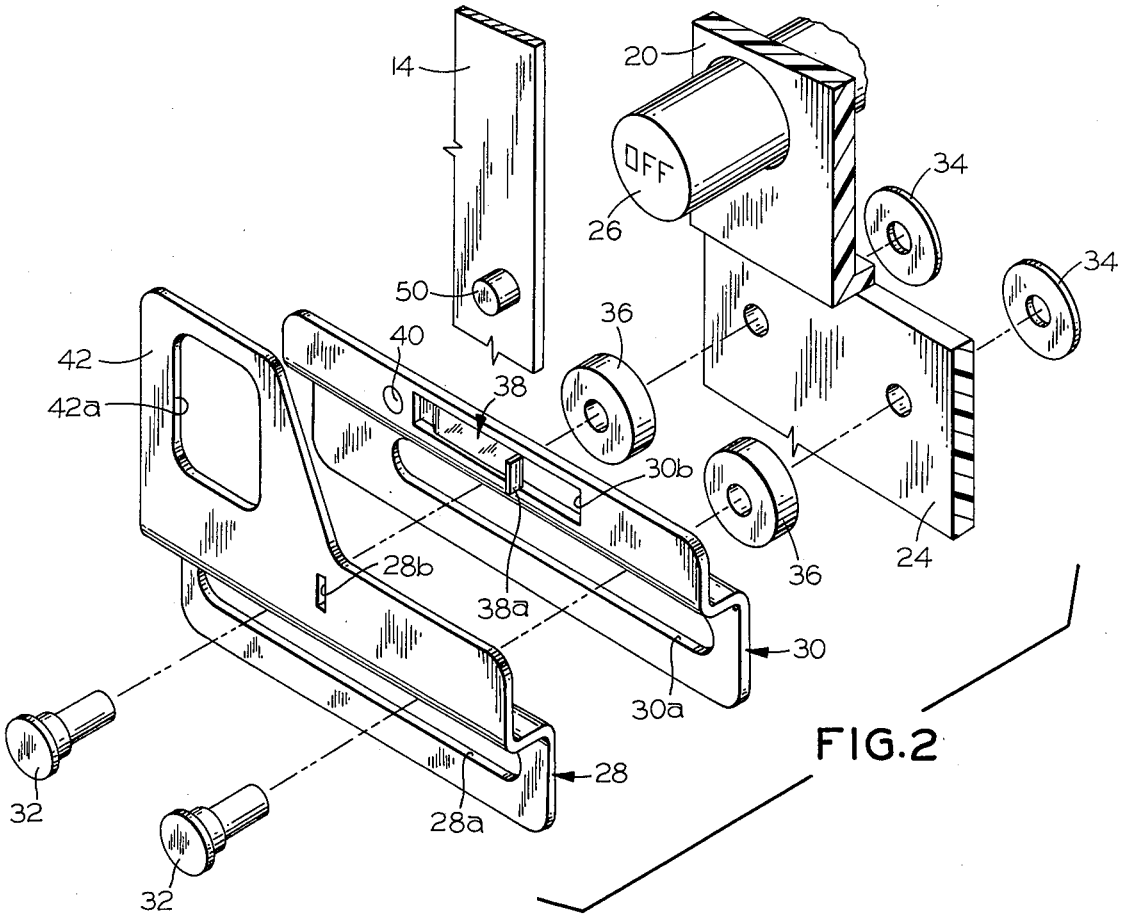
FIG. 2 is an exploded perspective view of the door interlock of FIG. 1.

Turning to FIG. 2, the door interlock 10 includes an outer elongated, plate-like first member, generally indicated at 28, and an underlying elongated, plate-like second member, generally indicated at 30. These plate members are each provided with elongated slots **28*a* and 30*a*, respectively, through which a pair of shouldered rivets 32 extend, pursuant to slideably mounting these plate members to the removable escutcheon plate 24. Washers 34 fitted on the inner ends of rivets 32 afford backing for the peened over ends of the rivets to ensure reliable mounting of the rivets to the molded plastic lower escutcheon plate 24. Spacer washers 36 are clamped between the rivet shoulders and the front surface of the lower escutcheon plate to rigidify the mounting of the rivets and thus ensure facile, non-binding sliding movement of the plate members 28 and 30**.

The upper and lower portions of the plate members may be offset as seen in FIG. 2, so as to accommodate differences in the raised levels of the fixed and removable escutcheon plates. Thus, in the illustrated embodiment, the fixed escutcheon plate 20 is raised to a greater extent from the front surface of the breaker cover 18 than the removable escutcheon plate 24.

Figure 3:
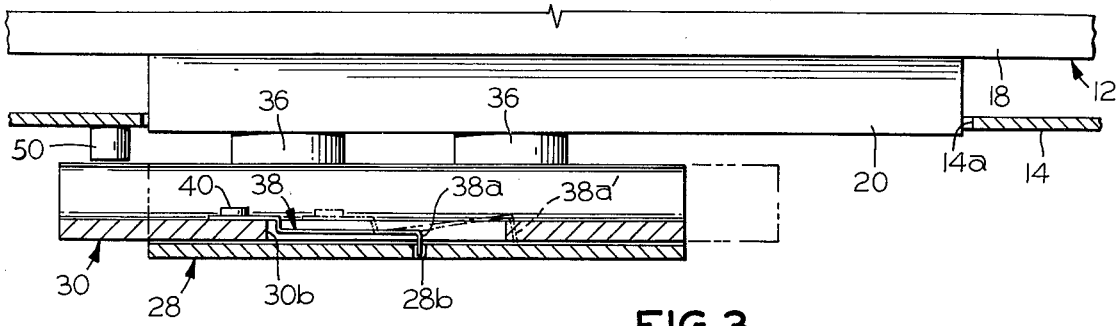
FIG. 3 is a planned view, partially broken away, of the door interlock of FIG. 1.

In accordance with the present invention, door interlock 10 is provided with discreetly defeatable coupling means for normally intercoupling the plates 28 and 30 for conjunctive sliding movement on the rivets. Thus, as seen in FIGS. 2 and 3, and elongated resilient coupling element, generally indicated at 38 and preferably formed from leaf spring stock, is affixed at one of its ends to the back side of underlying plate 30 by suitable means, such as a rivet 40. The body of this coupling element is forwardly offset from its mounted one end such that the major portion of its length is accommodated in an elongated slot **30*b* formed in plate 30. The free end of coupling element 38 is laterally turned outward to provide a tab 38*a* which, in the relaxed condition of the coupling element, projects beyond the front surface of plate 30 and into a minute, relatively unobtruse slot 28*b* provided in plate 28. It is thus seen that as long as tab 38*a* is lodged in slot 28*b*, the two plates are intercoupled for conjunctive sliding movement on rivets 32. However, if tab 38*a* is pushed out of slot 28*b* as indicated at 38*a*', using a suitable tool such as the tip of a small screwdriver, this intercoupling is defeated and plate 30 can slide independently of plate 28. When the plates are returned to their normal relative positions, wherein tab 38*a* registers with slot 28*b*, the resiliency of coupling element 38** causes the tab to spring into this slot to re-establish the intercoupled relationship of the two plates.

Figure 4:
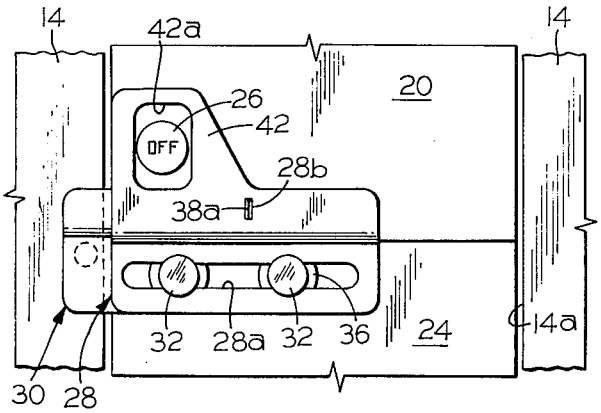
FIG. 4 is a fragmentary front elevational view of the door interlock of FIG. 1 in position to preclude opening of the access door while the circuit breaker is closed.

Still referring to FIG. 2, plate 28 is further provided with a transverse extension or flange 42 which projects upwardly in front of the fixed escutcheon 20. As seen in FIG. 4, this flange is provided with an opening or window **42*a* sized to accommodate the protrusion therethrough of circuit breaker pushbutton 26** in its elevated condition.

Having described the constructions of the various parts of the door interlock 10, reference will now be had to FIGS. 4 through 7 for a description of its operation in controlling access to the breaker enclosure in accordance with the condition of the circuit breaker therein. As seen in FIG. 4, the plates are in their respective first positions, wherein the window **42*a* of the flange extension 42 of plate 28 is registered with pushbutton 26 such that the latter may protrude therethrough to its elevated condition, while the left end portion of plate 30 overhangs the access door beyond the left edge of opening 14*a* therein such as to serve as a catch preventing the door from being swung open about its hinged right edge. If desired, a stud 50 may be affixed to the door to take up the space between the door and the overhanging catch end portion of plate 30. It is thus seen that as long as the plates are intercoupled by coupling element 38 and the pushbuttion protrudes through flange window 42*a*, sliding movement of the plates is precluded and door 14** cannot be opened.

Figure 5:
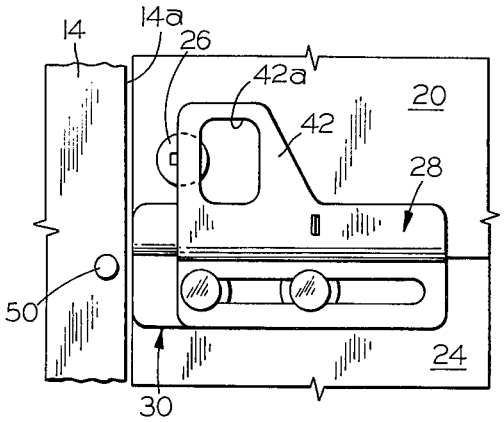
FIG. 5 is a fragmentary front elevational view of the door interlock of FIG. 1 in position to permit opening the access door while the circuit breaker is opened.

FIG. 5 illustrated respective second positions of the interlock plates assumed upon rightward sliding movement from their first positions in FIG. 4. To accomplish this, pushbutton 22 must be depressed to its depressed condition where it is below the level of flange 42. It is thus seen that the pushbutton's restraint on conjunctive rightward movement of the plates is removed. The rightward, second position by plate 30 removes its left catch end portion from interference with the access door, which can then be opened. It is also noted that with the plate 28 in its second, rightward position, the portion of flange 42 to the left of window 42*a* assumes overlying relation with the pushbutton to preserve its depressed condition. As a result, the circuit breaker cannot be reclosed.

Figure 6:
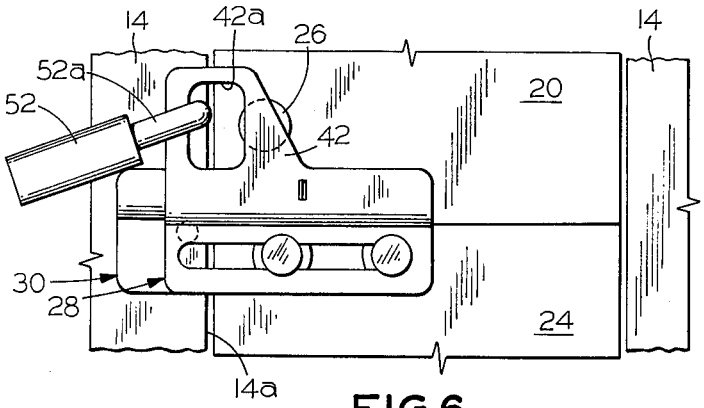
FIG. 6 is a fragmentary front elevational view of the door interlock of FIG. 1 in its padlocked position precluding opening of the access door and reclosure of the circuit breaker.

From FIG. 6 it is seen that the interlock plates can be slid in the opposite leftward direction from their first positions in FIG. 4 to respective third positions after the pushbutton has been shifted to its depressed condition to clear flange 42 carried by plate 28. Movement of plate 30 to its leftward, third position increases the amount of overhang of its left catch end portion with door 14, but more importantly, with plate 28 in its leftward, third position there is sufficient overhang with the door of the left end portion of plate 28; including flange 42, to interfere with the opening of the door. Moreover, window 42*a* extends sufficiently beyond the left edge of fixed escutcheon plate 20 to permit receipt of hasp 52*a* of a padlock 52. Thus padlocked, plate 28 cannot be slid to the right from its third position due to the interference of the padlock hasp with the raised left edge of the fixed escutcheon plate. Moreover, the portion of flange 42 to the right of its window 42*a* overlies the pushbutton 22 to sustain its depressed condition with the result that the door is locked closed and the circuit breaker is locked open or OFF.

Figure 7:
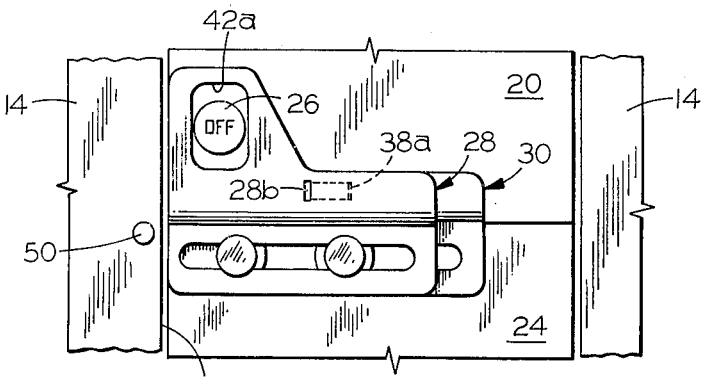
FIG. 7 is a fragmentary front elevational view of the door interlock of FIG. 1 in its defeated condition and in position to permit opening the access door while the circuit breaker is closed.

Now turning to FIG. 7, plate 28 is shown in its first position with window 42*a* registered with pushbutton 22 to permit the latter to protrude therethrough to its elevated position. However, plate 30 is shown in its second, rightward position with its left, catch end portion clear of the access door to permit its opening to access the circuit breaker enclosure. These relative positions of the interlock plates are achieved by defeating the intercoupling provided by coupling element 38. As previously described, this intercoupling is defeated by insertion of the tip of a small screwdriver into slot 28*b* in plate 28 to push tab 38*a* of coupling member 38 back out of slot 28*b*. Plate 30 may then be slid to the right to its second position, leaving the plate 28 in its first position, and thus the pushbutton need not be depressed to precipitate unwanted tripping of the circuit breaker to its open condition in order to slide the plate 30 to its rightward second position to clear the door pursuant to accessing the circuit breaker enclosure.

It will be noted that the padlocked condition of the circuit breaker and enclosure door seen in FIG. 6 cannot be defeated by decoupling the plates to permit rightward movement of plate 30, since it is plate 28 alone which, in its third position, serves both functions of inhibiting reclosure of the breaker and access to the breaker enclosure.

From the foregoing description, it will be appreciated that while the interlock plates are illustrated as being slideably mounted to the circuit breaker 12, they could be pivotally mounted for swinging movement between their various respective positions pursuant to achieving the objects of the present invention. It will also readily occur to those skilled in the art that the relative positions of the two interlock plates may be reversed without departing from the teachings of the present invention. This would simply involve mounting the coupling element 38 to plate 28 rather than plate 30 and providing the equivalent of slot 28*b* in plate 30 rather than plate 28. It will also be appreciated that the padlock hasp could be inserted through the plate slots 28*a*, 30*a* or separately provided holes in the door overhang portions of the plates to sustain their third positions of FIG. 6. Also, if the padlocking feature is not desired, the provision of a window in the flange 42 carried by plate 28 becomes unnecessary. Instead, the flange could be simply constituted by projections corresponding to those portions of the flange illustrated in the drawings to the left and right of window 42*a*. Alternatively, the breaker reclosure prevention or lockout feature of the invention may be omitted, which case plate 28 would be constructed so as to prevent movement of the plates from their first positions unless the pushbutton 26 is first depressed and then to allow the return of the pushbutton to its elevated condition after plate 28 has assumed its second or third positions.

It will thus be seen that the objects set forth above, among those made apparent in the preceding description, are efficiently attained, and since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. An interlock for controlling the opening of an access door to an enclosure in accordance with the condition of a circuit breaker situated therein, the circuit breaker being equipped with a pushbutton which is manipulated from an elevated condition to a depressed condition to convert the breaker from its ON condition to its OFF condition, said interlock comprising, in combination:

A. a first member;

B. a second member;

C. means commonly mounting said first and second members to the circuit breaker for movements between respective first and second positions;

D. control means carried by said first member, said control means (1) abutting the pushbutton in its elevated position to preclude movement of said first member from its first to its second position, and (2) clearing the pushbutton in its depressed condition to permit movement of said first member from its first to its second position;

E. catch means carried by said second member, said catch means interfering with the opening of the access door while said second member is in its first position and clearing the access door while said second member is in its second position; and F. coupling means normally intercoupling said first and second members for conjunctive movement between their respective first and second positions, whereby to preclude opening of the access door while the breaker is in its ON condition, said coupling means being manually defeatable to decouple said first and second members, whereby said second member is movable independently of said first member from its first to its second position to permit opening of the access door without having to convert the circuit breaker from its ON condition to its OFF condition.

2. The interlock defined in claim 1, wherein said coupling means is mounted by one of said first and second memebrs and releasably engages the other of said first and second members pursuant to intercoupling said members for conjunctive movement.

3. The interlock defined in claim 2, wherein said coupling means comprises a spring element affixed at one end to said one of said first and second members and having a laterally turned other end portion arranged for disposal in a slot formed in said other of said first and second members pursuant to intercoupling said members for conjunctive movement, said spring element being accessible for deflection to remove said laterally turned end portion from said slot pursuant to decoupling said first and second members.

4. The interlock defined in claim 3, which further includes means forming an opening in said one member, said spring affixed at said one end to the side of said one member opposite from said other member, and having a body portion intermediate its ends accommodated in said opening in order to present said laterally turned end portion for disposal in said slot.

5. The interlock defined in claim 1, wherein the pushbutton in its depressed condition inhibits conversion of the breaker from its OFF to its ON condition, and wherein said control means overlies the pushbutton to sustain its depressed condition while said first member is in its second position.

6. The interlock defined in claim 1, wherein the pushbutton in its depressed condition inhibits conversion of the breaker from its OFF to its ON condition, and wherein said control means includes a flange integral with said first member, and means forming a window in said flange through which the pushbutton in its elevated condition protrudes while said first member is in its first position, said flange overlying the pushbutton to sustain its depressed condition while said first member is in its second position.

7. The interlock defined in claim 6, wherein said coupling means comprises a spring element affixed at one end to one of said first and second members and having a laterally turned other end portion arranged for disposal in a slot formed in the other of said first and second members pursuant to intercoupling said members for conjunctive movement, said spring element being accessible for deflection to remove said laterally turned end portion from said slot pursuant to decoupling said first and second members.

8. The interlock defined in claim 1, wherein said mounting means is structured to mount said first and second members for sliding movement between their respective first and second positions.

9. The interlock defined in claim 8, wherein the pushbutton in its depressed condition inhibits conversion of the breaker from its OFF to its ON condition, and wherein said control means includes a flange integral with said first member, and means forming a window in said flange through which the pushbutton in its elevated condition protrudes while said first member is in its first position, said flange overlying the pushbutton to sustain its depressed condition while said first member is in its second position.

10. The interlock defined in claim 9, wherein said coupling means comprises a spring element affixed at one end to one of said first and second members and having a laterally turned other end portion arranged for disposal in a slot formed in the other of said first and second members prusuant to intercoupling said members for conjunctive movement, said spring element being accessible for deflection to remove said laterally turned end portion from said slot pursuant to decoupling said first and second members.

11. The interlock defined in claim 1, wherein at least one of said first and second members includes means accommodating a padlock for locking said one member in position to bar opening of the access door.

12. The interlock defined in claim 1, wherein the pushbutton in its depressed condition inhibits conversion of the breaker from its OFF to its ON condition, and wherein said mounting means mounts said first and second members for movement to respective third positions located to the opposite side of their respective first positions from their respective second positions, with said first member in said third position, said control means overlying the pushbutton to sustain its depressed condition and overlying an edge of the access door to preclude opening same, said control means further including means accommodating a padlock pursuant to locking said first member in its third position.

13. The interlock defined in claim 12, wherein said control means also overlies the pushbutton to sustain its depressed condition while said first member is in its second position.

14. The interlock defined in claim 13, wherein said control means includes a flange integral with said first member and means forming a window in said flange through which the pushbutton in its elevated condition protrudes while said first member is in its first position, with said first member in either its second or third position, said flange overlying the pushbutton to sustain its depressed condition.

15. The interlock defined in claim 14, wherein said mounting means is structured to mount said first and second members for sliding movement to their respective first, second and third positions.

16. The interlock defined in claim 15, wherein said coupling means comprises a spring element affixed at one end to one of said first and second members and having a laterally turned other end portion arranged for disposal in a slot formed in the other of said first and second members pursuant to intercoupling said members for conjunctive movement, said spring element being accessible for deflection to remove said laterally turned end portion from said slot pursuant to decoupling said first and second members.

* * * * *